US008277173B2

(12) United States Patent
Yamashita et al.

(10) Patent No.: US 8,277,173 B2
(45) Date of Patent: Oct. 2, 2012

(54) TURBINE ROTOR AND STEAM TURBINE

(75) Inventors: Katsuya Yamashita, Tokyo (JP); Takao Inukai, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1327 days.

(21) Appl. No.: 11/956,083

(22) Filed: Dec. 13, 2007

(65) Prior Publication Data

US 2008/0166222 A1 Jul. 10, 2008

(30) Foreign Application Priority Data

Dec. 15, 2006 (JP) ..... 2006-338937

(51) Int. Cl.
*F01D 5/08* (2006.01)

(52) U.S. Cl. ..... 415/117; 415/116; 415/180; 415/216.1; 416/95; 416/198 A; 416/201 R; 416/244 A

(58) Field of Classification Search ..... 415/115, 415/116, 117, 180, 216.1; 416/95, 96 R, 416/96 A, 97 R, 198 A, 201 R, 213 R, 244 A
See application file for complete search history.

(56) References Cited

U.S. PATENT DOCUMENTS

| | | | | |
|---|---|---|---|---|
| 5,525,032 | A | 6/1996 | Kreis et al. | |
| 5,993,154 | A | 11/1999 | Endres et al. | |
| 6,095,751 | A * | 8/2000 | Hirokawa et al. | 416/96 R |
| 6,152,697 | A | 11/2000 | Konishi et al. | |
| 6,234,746 | B1 * | 5/2001 | Schroder et al. | 415/115 |
| 6,261,063 | B1 * | 7/2001 | Chikami et al. | 416/198 A |
| 7,267,525 | B2 | 9/2007 | Hiegemann et al. | |
| 2002/0187046 | A1 | 12/2002 | Beutin et al. | |
| 2004/0261417 | A1 | 12/2004 | Yamashita et al. | |
| 2005/0022527 | A1 | 2/2005 | Nagane et al. | |
| 2005/0118025 | A1 | 6/2005 | Hiegemann et al. | |
| 2007/0253812 | A1 | 11/2007 | Yamashita | |

FOREIGN PATENT DOCUMENTS

| | | | |
|---|---|---|---|
| CH | 353218 | A | 3/1961 |
| EP | 1 536 102 | A2 | 6/2005 |
| JP | 57-103301 | U | 6/1982 |
| JP | 7-247806 | A | 9/1995 |
| JP | 7-279605 | A | 10/1995 |
| JP | 2000-064805 | A | 2/2000 |
| JP | 3095745 | B1 | 8/2000 |
| JP | 2000-282808 | A | 10/2000 |
| JP | 2004-353603 | A | 12/2004 |
| JP | 2007-291966 | A | 11/2007 |

* cited by examiner

*Primary Examiner* — Christopher Verdier
(74) *Attorney, Agent, or Firm* — Foley & Lardner LLP

(57) ABSTRACT

A turbine rotor 300 includes: a high-temperature turbine rotor constituent part 301 where high-temperature steam passes; low-temperature turbine rotor constituent parts 302 sandwiching and weld-connected to the high-temperature turbine rotor constituent part 301 and made of a material different from a material of the high-temperature turbine rotor constituent part 301; and a cooling part cooling the high-temperature turbine rotor constituent part 301 by ejecting cooling steam 240 to a position, of the high-temperature turbine rotor constituent part 301, near a welded portion 120 between the high-temperature turbine rotor constituent part 301 and the low-temperature turbine rotor constituent part 302. A value equal to a distance divided by a diameter is equal to or more than 0.3, where the distance is a distance from the position, of the high-temperature turbine rotor constituent part 301, ejected the cooling steam 240 up to the welded portion 120, and the diameter is a turbine rotor diameter of the high-temperature turbine rotor constituent part 301.

13 Claims, 7 Drawing Sheets

TURBINE ROTOR AND STEAM TURBINE

CROSS-REFERENCE TO RELATED APPLICATIONS

This application is based upon and claims the benefit of priority from the prior Japanese Patent Application No. 2006-338937, filed on Dec. 15, 2006; the entire contents of which are incorporated herein by reference.

BACKGROUND

1. Field of the Invention

The present invention relates to a turbine rotor formed of different materials welded together and a steam turbine including the turbine rotor.

2. Description of the Related Art

For most of high-temperature parts in thermal power generation facilities, ferritic heat-resistant steels excellent in manufacturability and economic efficiency have been used. A steam turbine of such a conventional thermal power generation facility is generally under a steam temperature condition on order of 600° C. or lower, and therefore, its major components such as a turbine rotor and moving blades are made of ferritic heat-resistant steel.

However, in recent years, improvement in efficiency of thermal power generation facilities have been actively promoted from a viewpoint of environmental protection, and accordingly, steam turbines utilizing high-temperature steam at about 600° C. are operated. Such a steam turbine includes components whose necessary characteristics cannot be satisfied by characteristics of the ferritic heat-resistant steel, and therefore, these components are sometimes made of a heat-resistant alloy or austenitic heat-resistant steel more excellent in high-temperature resistance.

For example, JP-A 7-247806(KOKAI), JP-A 2000-282808(KOKAI), and Japanese Patent Publication No. 3095745 (JP-B2) disclose arts to construct a steam turbine power generation facility with the minimum use of an austenitic material for a steam turbine utilizing high-temperature steam at 650° C. or higher. For example, in the steam turbine power generation facility described in JP-A 2000-282808 (KOKAI), a superhigh-pressure turbine, a high-pressure turbine, an intermediate-pressure turbine, a low-pressure turbine, a second low-pressure turbine, and a generator are uniaxially connected, and the super high-pressure turbine and the high-pressure turbine are assembled in the same outer casing and thus are independent of the others.

Further, in view of global environmental protection, a need for still higher efficiency enabling a reduction in emissions of $CO_2$, SOx, and NOx is currently increasing. One of the most effective measures to enhance plant thermal efficiency in a thermal power generation facility is to increase steam temperature, and the development of a steam turbine utilizing steam whose temperature is on order of 700° C. is under consideration.

Further, for example, JP-A 2004-353603(KOKAI) discloses an art to cool turbine components by cooling steam in order to cope with the aforesaid increase in the steam temperature.

For example, in the development of a steam turbine to which steam at a temperature of 630° C. or higher is introduced, there are many problems to be solved, in particular, regarding how strength of turbine components can be ensured. In thermal power generation facilities, improved heat-resistant steel has been conventionally used for turbine components such as a turbine rotor, nozzles, moving blades, a nozzle box (steam chamber), and a steam supply pipe included in a steam turbine, but when the temperature of reheated steam becomes 630° C. or higher, it is difficult to maintain high level of strength guarantee of the turbine components.

Under such circumstances, there is a demand for realizing a new art that is capable of maintaining high level of strength guarantee of turbine components in a steam turbine even when conventional improved heat-resistant steel is used as it is for the turbine components. One prospective new art to realize this is to use cooling steam for cooling the aforesaid turbine components. However, to cool, for example, a turbine rotor and a casing by the cooling steam in order to use the conventional material for portions corresponding to and after a first-stage turbine, a required amount of the cooling steam amounts to several % of an amount of main steam. Moreover, since the cooling steam flows into a channel portion, there arises a problem of deterioration in internal efficiency of a turbine itself in accordance with deterioration in blade cascade performance.

In a case where the high-temperature parts and the low-temperature parts are joined by welding or the like, the former being made of a Ni-based alloy such as Inco625, Inco617, and Inco713 (manufactured by Inco Limited) or austenitic steel such as SUS310, all of which are materials excellent in strength under high temperature and having steam oxidation resistance, and the latter being made of ferritic steel, new 12Cr steel, advanced 12Cr steel, 12Cr steel, or CrMoV steel, there occurs a problem of thermal stress generated in welded portions. Specifically, since a coefficient of linear expansion of a Ni-based alloy or austenitic steel used for the high-temperature parts is larger than a coefficient of linear expansion of ferritic steel or the like used for the low-temperature parts, a large thermal stress is generated in the welded portions due to a difference in expansion, which may possibly break a portion near the welded portions.

BRIEF SUMMARY OF THE INVENTION

It is an object of the present invention to provide a turbine rotor and a steam turbine in which the generation of thermal stress in welded portions can be reduced, and which can have improved thermal efficiency by being driven by high-temperature steam and have excellent reliability.

According to an aspect of the present invention, there is provided a turbine rotor penetratingly provided in a steam turbine to which high-temperature steam is introduced, the turbine rotor including: a high-temperature turbine rotor constituent part where the high-temperature steam passes; low-temperature turbine rotor constituent parts sandwiching and weld-connected to the high-temperature turbine rotor constituent part and made of a material different from a material of the high-temperature turbine rotor constituent part; and a cooling part cooling the high-temperature turbine rotor constituent part by ejecting cooling steam to a position, of the high-temperature turbine rotor constituent part, near a welded portion between the high-temperature turbine rotor constituent part and the low-temperature turbine rotor constituent part, wherein a value equal to a distance divided by a diameter is equal to or more than 0.3, where the distance is a distance from the position, of the high-temperature turbine rotor constituent part, ejected the cooling steam by the cooling part up to the welded portion, and the diameter is a turbine rotor diameter of the high-temperature turbine rotor constituent part.

According to another aspect of the present invention, there is provided a steam turbine to which high-temperature steam is introduced and which includes a turbine rotor penetratingly provided in the steam turbine, wherein the turbine rotor includes: a high-temperature turbine rotor constituent part where the high-temperature steam passes; low-temperature turbine rotor constituent parts sandwiching and weld-connected to the high-temperature turbine rotor constituent part and made of a material different from a material of the high-temperature turbine rotor constituent part; and a cooling part cooling the high-temperature turbine rotor constituent part by ejecting cooling steam to a position, of the high-temperature turbine rotor constituent part, near a welded portion between the high-temperature turbine rotor constituent part and the low-temperature turbine rotor constituent part, wherein a value equal to a distance divided by a diameter is equal to or more than 0.3, where the distance is a distance from the position, of the high-temperature turbine rotor constituent part, ejected the cooling steam by the cooling part up to the welded portion, and the diameter is a turbine rotor diameter of the high-temperature turbine rotor constituent part.

BRIEF DESCRIPTION OF THE DRAWINGS

The present invention will be described with reference to the drawings, but these drawings are provided only for an illustrative purpose and in no way are intended to limit the present invention.

DETAILED DESCRIPTION OF THE INVENTION

Hereinafter, embodiments of the present invention will be described with reference to the drawings.

First Embodiment

Figure 1:
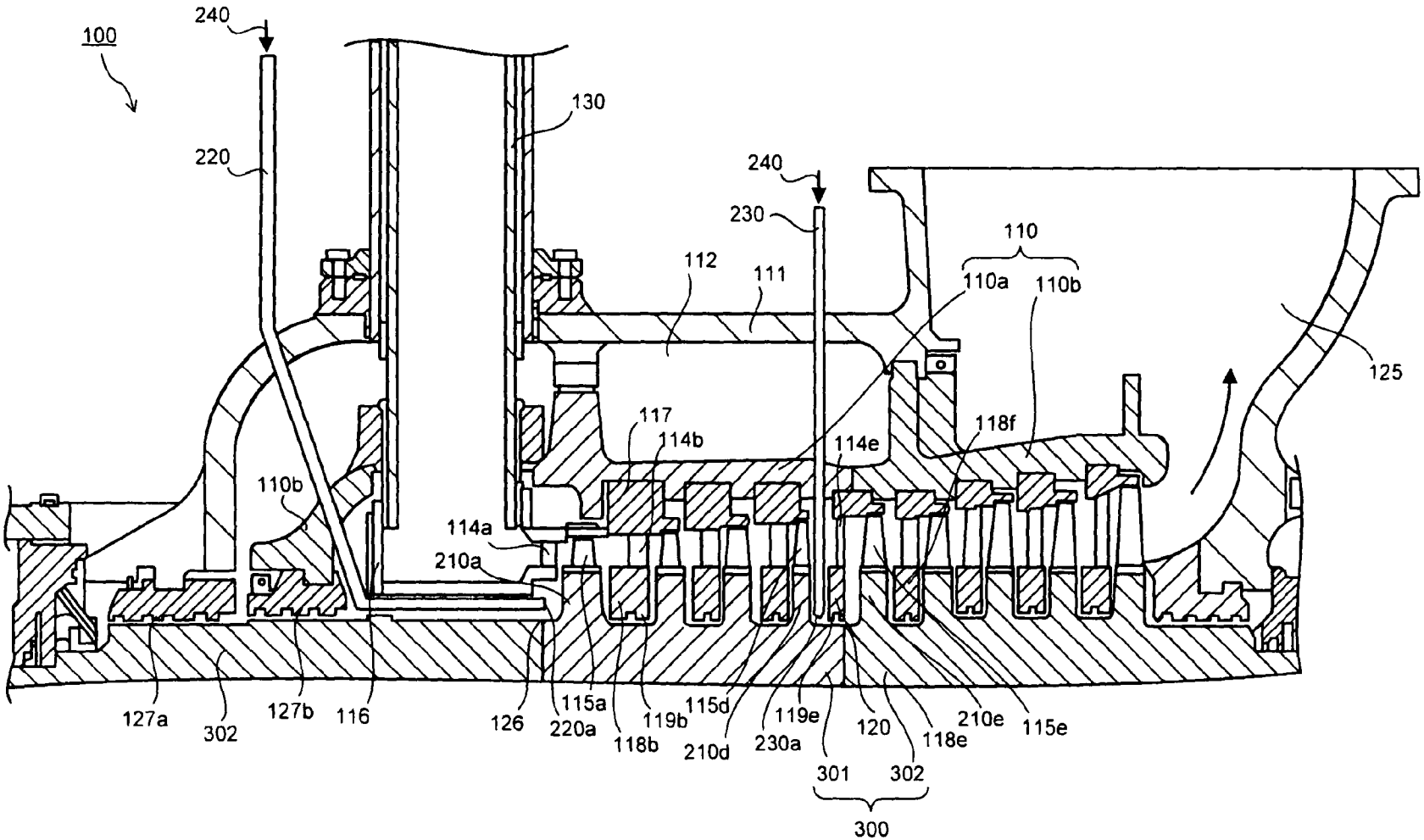
FIG. 1 is a view showing a cross section of an upper casing part of a steam turbine including a turbine rotor of a first embodiment according to the present invention.

FIG. 1 is a view showing a cross section of an upper casing part of a steam turbine 100 including a turbine rotor 300 of a first embodiment.

As shown in FIG. 1, the steam turbine 100 includes a dual-structured casing composed of an inner casing 110 and an outer casing 111 provided outside the inner casing 110, and a heat chamber 112 is formed between the inner casing 110 and the outer casing 111. A turbine rotor 300 is penetratingly provided in the inner casing 110. Further, many stages of nozzle diaphragm outer rings 117 are connected to an inner peripheral surface of the inner casing 110, and for example, nine-stages of nozzles 114*a*, 114*b*, . . . are provided. Further, in the turbine rotor 300, moving blades 115*a* . . . corresponding to these nozzles 114*a*, 114*b*, . . . are implanted in wheel parts 210*a* . . . . Further, nozzle labyrinths 119*b* . . . are provided in turbine rotor 300 side surfaces of nozzle diaphragm inner rings 118*b* . . . to prevent the leakage of steam.

This turbine rotor 300 is composed of a high-temperature turbine rotor constituent part 301 and low-temperature turbine rotor constituent parts 302 sandwiching and weld-connected to the high-temperature turbine rotor constituent part 301. The high-temperature turbine rotor constituent part 301 is provided in an area extending from a position corresponding to the initial-stage nozzle 114*a* (where temperature of steam is about 630° C. to about 750° C.) to a position substantially corresponding to a downstream end portion of the nozzle labyrinth 119*e* provided in the nozzle diaphragm inner ring 118*e* positioned on an immediate upstream side of the moving blade 115*e* where the temperature of the flowing steam becomes 550° C. or lower. The low-temperature turbine rotor constituent parts 302 are provided in areas where the temperature of the steam is below 550° C.

The aforesaid inner casing 110 is composed of: a high-temperature casing constituent part 110*a* covering the area where the high-temperature turbine rotor constituent part 301 is penetratingly provided; and low-temperature casing constituent parts 110*b* covering the areas where the low-temperature turbine rotor constituent parts 302 are penetratingly provided. The high-temperature casing constituent part 110*a* and each of the low-temperature casing constituent parts 110*b* are connected by welding or bolting.

The high-temperature turbine rotor constituent part 301 and the high-temperature casing constituent part 110*a* are exposed to the steam whose temperature ranges from high temperature of about 630° C. to about 750° C. which is inlet steam temperature up to about 550° C., and therefore are made of a corrosion- and heat-resistant material or the like whose mechanical strength (for example, a hundred thousand-hour creep rupture strength) at high temperatures is high and which has steam oxidation resistance. As the corrosion- and heat-resistant material, a Ni-based alloy is used, for instance, and concrete examples thereof are Inco625, Inco617, Inco713, and the like manufactured by Inco Limited. The nozzles 114*a* . . . , the nozzle diaphragm outer rings 117, the nozzle diaphragm inner rings 118*b* . . . , the moving blades 115*a* . . . , and so on positioned in the area exposed to the steam whose temperature ranges from the high inlet steam temperature of about 630° C. to about 750° C. up to about 550° C., that is, an area between the high-temperature turbine rotor constituent part 301 and the high-temperature casing constituent part 110*a* are also made of the aforesaid corrosion- and heat-resistant material.

The low-temperature turbine rotor constituent parts 302 and the low-temperature casing constituent parts 110*b* exposed to the steam at temperatures lower than 550° C. are made of a material different from the aforesaid material forming the high-temperature turbine rotor constituent part 301 and the high-temperature casing constituent part 110*a*, and are preferably made of ferritic heat-resistant steel or the like which has conventionally been in wide use as a material of a turbine rotor and a casing. Concrete examples of this ferritic heat-resistant steel are new 12Cr steel, advanced 12Cr steel, 12Cr steel, 9Cr steel, CrMoV steel, and the like but are not limited to these.

The steam turbine 100 further has a steam inlet pipe 130 which penetrates the outer casing 111 and the inner casing 110 and whose end portion communicates with and is connected to a nozzle box 116 guiding the steam out to a moving blade 115*a* side. The steam inlet pipe 130 and nozzle box 116 are exposed to the high-temperature steam whose temperature is about 630° C. to about 750° C. which is the inlet steam temperature, and therefore are made of the aforesaid corrosion- and heat-resistant material. Here, the nozzle box 116 may be structured such that a cooling steam channel for having cooling steam pass therethrough is formed in its wall and an inner surface of its wall is covered by shielding plates provided at intervals, as disclosed in Japanese Patent Application Laid-open No. 2004-353603. This structure can reduce thermal stress and the like generated in the wall of the nozzle box, so that a high level of strength guarantee can be maintained.

As shown in FIG. 1, a cooling steam supply pipe 220 is disposed along the turbine rotor 300, and the cooling steam supply pipe 220 ejects cooling steam 240 from the vicinity of a welded portion 126, whose position corresponds to the initial-stage nozzle 114*a*, toward the wheel part 210*a* corresponding to the initial-stage moving blade 115*a*. Further, a cooling steam supply pipe 230 is disposed between the moving blade 115*d*, which is positioned on an immediate upstream side (one-stage upstream side) of the moving blade 115*e* on a stage where the steam temperature becomes 550° C. or lower, and the nozzle 114*e* positioned on an immediate downstream side of the moving blade 115*d*, and the cooling steam supply pipe 230 ejects the cooling steam 240 toward the high-temperature turbine rotor constituent part 301. Each of the cooling steam supply pipes 220, 230 may be provided in plurality at predetermined intervals around the high-temperature turbine rotor constituent part 301.

The cooling steam supply pipe 230 preferably ejects the cooling steam 240 toward a root portion or a side surface of the wheel part 210*d* implanted with the moving blade 115*d*. Therefore, a steam ejection port 230*a* of the cooling steam supply pipe 230 is preferably directed toward the root portion or the side surface of this wheel part 210*d*. These cooling steam supply pipes 220, 230 function as cooling means, and the cooling steam 240 ejected from the cooling steam supply pipes 220, 230 cool the turbine rotor 300, the welded portions 120, 126, and so on.

As the cooling steam 240, steam at a temperature of 500° C. or lower is preferably used. The reason why the use of the steam at a temperature of 500° C. or lower is preferable is that such cooling steam can lower the temperature of the high-temperature turbine rotor constituent part 301 made of a Ni-based alloy or austenitic steel high in coefficient of linear expansion to reduce an expansion difference acting on the vicinities of the welded portions 120, 126, enabling effective inhibition of the generation of thermal stress. A flow rate of the ejected cooling steam 240 is preferably set to 8% or lower of a flow rate of a main steam flowing in the steam turbine 100. The reason why the preferable flow rate of the cooling steam 240 is 8% or lower of the flow rate of the main stream is that this gives little influence to turbine plant efficiency. Examples usable as the cooling steam 240 are steam extracted from a high-pressure turbine, a boiler, or the like, steam extracted from a middle stage of the steam turbine 100, steam discharged to a discharge path 125 of the steam turbine 100, and so on, and a supply source of the cooling steam 240 is appropriately selected based on the set temperature of the cooling steam 240.

Next, with reference to FIG. 2 and FIG. 3, a description will be given of the relation between a distance L and a diameter D, where L is a distance from the position, of the high-temperature turbine rotor constituent part 301, ejected the cooling steam 240 by the cooling steam supply pipe 230 up to the welded portion 120, and D is a turbine rotor diameter D of the high-temperature turbine rotor constituent part 301.

Figure 2:
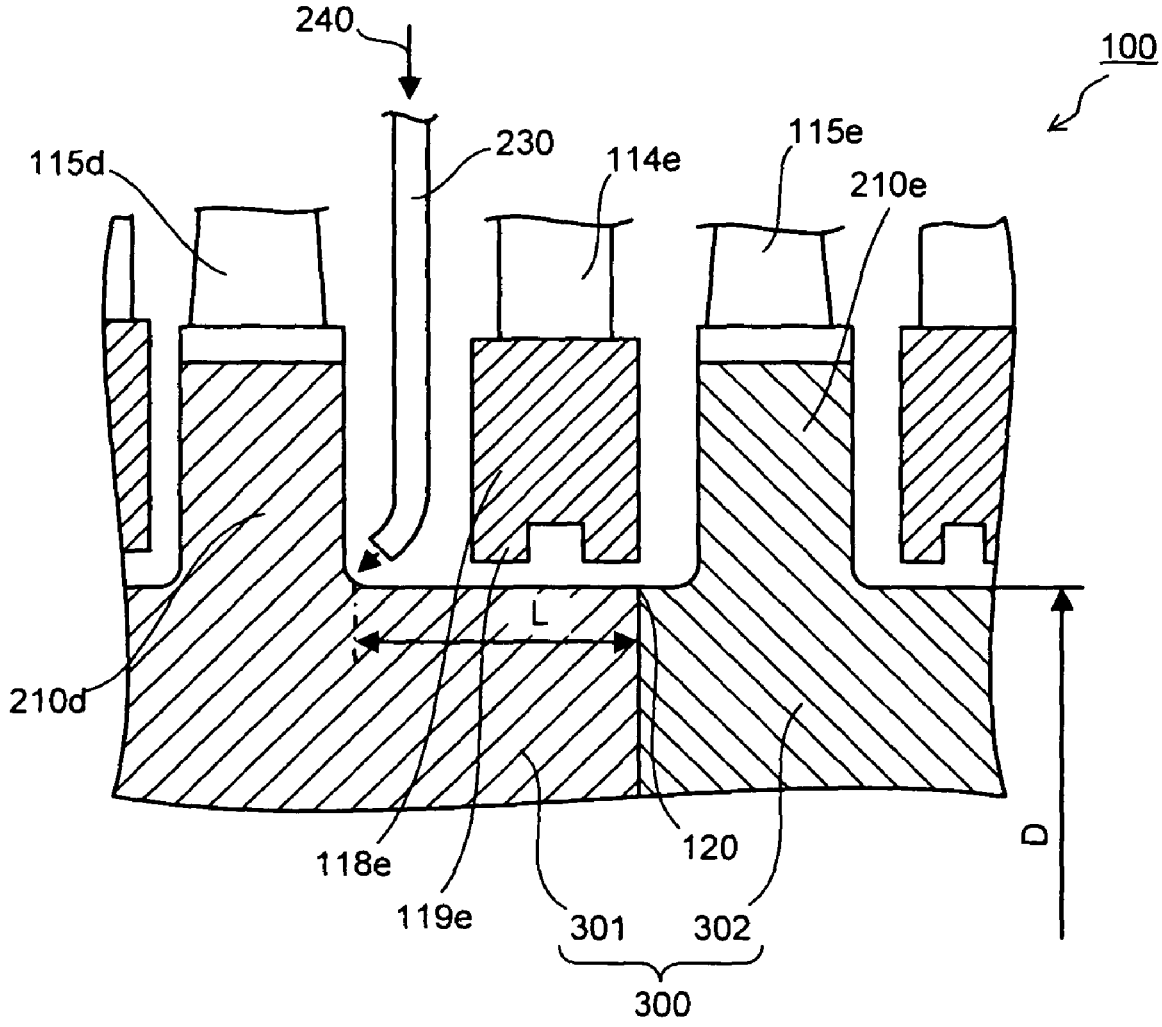
FIG. 2 is an enlarged view of a cross section of a portion including a position, of a high-temperature turbine rotor constituent part, ejected cooling steam by a cooling steam supply pipe and a welded portion.

FIG. 2 is an enlarged view of a cross section of a portion including the position, of the high-temperature turbine rotor constituent part 301, ejected the cooling steam 240 by the cooling steam supply pipe 230 and the welded portion 120. FIG. 3 is a graph showing the correlation between a value (L/D) and thermal stress, where L is the distance from the position, of the high-temperature turbine rotor constituent part 301, ejected the cooling steam 240 by the cooling steam supply pipe 230 up to the welded portion 120, D is the turbine rotor diameter of the high-temperature turbine rotor constituent part 301, and the value L/D is a value equal to the distance L divided by the turbine rotor diameter D.

Here, the position, of the high-temperature turbine rotor constituent part 301, ejected the cooling steam 240 by the cooling steam supply pipe 230 means a position, of the high-temperature turbine rotor constituent part 301, directly ejected the cooling steam 240. The cooling of the high-temperature turbine rotor constituent part 301 starts from the position, of the high-temperature turbine rotor constituent part 301, directly ejected the cooling steam 240 and progresses in a direction toward the welded portion 120, that is, in a flow direction of the cooling steam 240. The thermal stress is thermal stress generated in the welded portion 120.

Figure 3:
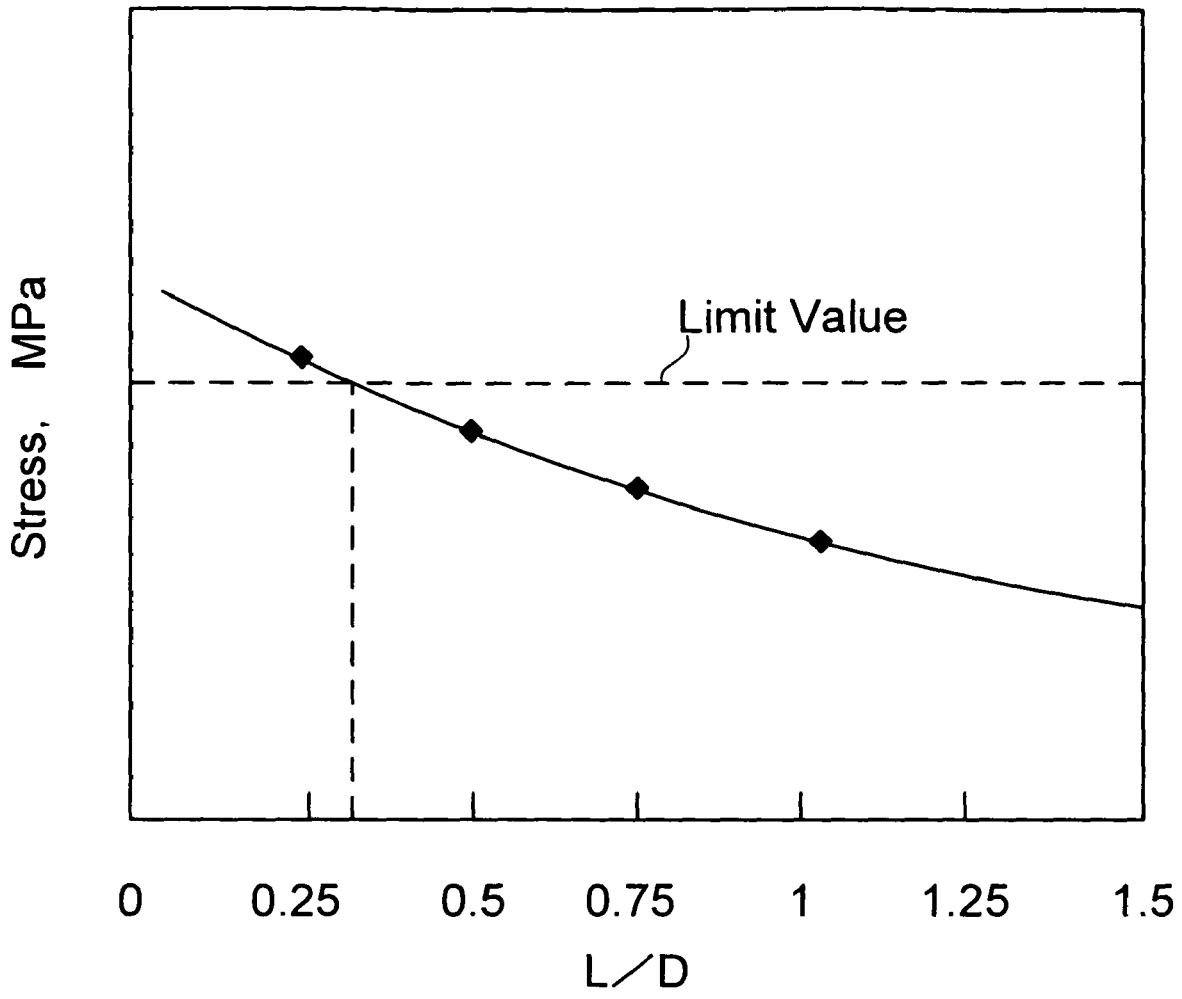
FIG. 3 is a graph showing the correlation between a value (L/D) and thermal stress, where L is a distance from the position, of the high-temperature turbine rotor constituent part, ejected the cooling steam by the cooling steam supply pipe up to the welded portion, D is a turbine rotor diameter of the high-temperature turbine rotor constituent part, and the value L/D is a value equal to the distance L divided by the turbine rotor diameter D.

As shown in FIG. 3, the thermal stress increases in accordance with a decrease in the value (L/D) equal to the distance L, which is from the position of the high-temperature turbine rotor constituent part 301 ejected the cooling steam 240 by the cooling steam supply pipe 230 up to the welded portion 120, divided by the turbine rotor diameter D of the high-temperature turbine rotor constituent part 301. When the value of L/D becomes smaller than 0.3, the thermal stress exceeds a limit value. As described above, it is necessary to set the value of L/D to 0.3 or more in order to make the thermal stress equal to or lower than the limit value, and this range is a range of the value of L/D in the present invention. That is, the position ejected the cooling steam 240 in the high-temperature turbine rotor constituent part 301 and the position of the welded portion 120 are set based on the turbine rotor diameter of the used high-temperature turbine rotor constituent part 301.

The above description is on how the value (L/D) equal to the distance L, which is from the position of the high-temperature turbine rotor constituent part 301 ejected the cooling steam 240 by the cooling steam supply pipe 230 up to the welded portion 120, divided by the turbine rotor diameter D of the high-temperature turbine rotor constituent part 301 correlates with the thermal stress, but a value equal to a distance, which is from the position of the high-temperature turbine rotor constituent part 301 ejected the cooling steam 240 by the cooling steam supply pipe 220 up to the welded portion 126, divided by the turbine rotor diameter D of the high-temperature turbine rotor constituent part 301 has the same correlation with the thermal stress. That is, the value (L/D) equal to the distance L, which is from the position of the high-temperature turbine rotor constituent part 301 ejected the cooling steam 240 by the cooling steam supply pipe 220 up to the welded portion 126, divided by the turbine rotor diameter D of the high-temperature turbine rotor constituent part 301 is set to 0.3 or more. In this case, the position ejected the cooling steam 240 in the high-temperature turbine rotor constituent part 301 and the position of the welded portion 126 are set also based on the turbine rotor diameter of the used high-temperature turbine rotor constituent part 301.

As shown in FIG. 2, the welded portion 120 is preferably formed at a position substantially corresponding to a downstream end portion of the nozzle diaphragm inner ring 118*e* positioned on an immediate upstream side of the moving blade 115*e* on a stage where the steam temperature becomes 550° C. or lower, or at a position substantially corresponding to a downstream end portion of the nozzle labyrinth 119*e* provided in the nozzle diaphragm inner ring 118*e*.

Next, the operation in the steam turbine 100 will be described with reference to FIG. 1.

The steam at a temperature of about 630° C. to about 750° C. which flows into the nozzle box 116 in the steam turbine 100 after passing through the steam inlet pipe 130 passes through a steam channel between the nozzles 114*a* . . . fixed to the inner casing 110 and the moving blades 115*a* . . . implanted in the turbine rotor 300 to rotate the turbine rotor 300. Further, most of the steam having finished expansion work is discharged out of the steam turbine 100 through the discharge path 125 and flows into a boiler through, for example, a low-temperature reheating pipe not shown.

Incidentally, the above-described steam turbine 100 may include a structure for introducing, as the cooling steam, part of the steam having finished the expansion work to an area between the inner casing 110 and the outer casing 111 to cool the outer casing 111 and the inner casing 110. In this case, the cooling steam is discharged through a gland sealing part 127*a* or the discharge path 125. It should be noted that a method of introducing the cooling steam is not limited to this, and for example, steam extracted from a middle stage of the steam turbine 100 or steam extracted from another steam turbine may be used as the cooling steam.

Further, the cooling steam 240 ejected from the steam ejection port 230*a* of the cooling steam supply pipe 230 and ejected to the high-temperature turbine rotor constituent part 301 flows downstream while cooling a portion, of the high-temperature turbine rotor constituent part 301, on an immediate downstream side of the moving blade 115*d*. Then, the cooling steam 240 further flows downstream between the high-temperature turbine rotor constituent part 301 and the nozzle labyrinth 119*e* to cool the welded portion 120 and its vicinity.

The cooling steam 240 ejected from a steam ejection port 220*a* of the cooling steam supply pipe 220 collides with the wheel part 210*a* corresponding to the initial-stage moving blade 115*a* to cool the wheel part 210*a*, and further flows from the high-temperature turbine rotor constituent part 301 toward the low-temperature turbine rotor constituent part 302 side to cool the high-temperature turbine rotor constituent part 301, the welded portion 126, and its vicinity. Then, the cooling steam 240 passes through the gland sealing part 127*b*, and part thereof flows between the outer casing 111 and the inner casing 110 to cool the both casings. Further, the cooling steam 240 is introduced into the heat chamber 112 to be discharged through the discharge path 125. On the other hand, the rest of the cooling steam 240 having passed through the gland sealing part 127*b* passes through a gland sealing part 127*a* to be discharged.

As described above, according to the steam turbine 100 of the first embodiment and the turbine rotor 300 penetratingly provided in the steam turbine 100, since the cooling steam 240 is ejected to the positions, of the high-temperature turbine rotor constituent part 301, near the welded portions 120, 126 between the high-temperature turbine rotor constituent part 310 and the low-temperature turbine rotor constituent parts 302 to cool these areas, it is possible to reduce the thermal stress generated on joint surfaces of the welded portions 120, 126 due to a difference in coefficient of linear expansion between the materials forming the high-temperature turbine rotor constituent part 301 and the low-temperature turbine rotor constituent parts 302, enabling the prevention of breakage and the like. Further, since the positions, of the high-temperature turbine rotor constituent part 301, ejected the cooling steam 240 and the turbine rotor diameter D of the high-temperature turbine rotor constituent part 301 are set so that the value (L/D) equal to the distance L, which is from the positions of the high-temperature turbine rotor constituent part 301 ejected the cooling steam 240 by the cooling steam supply pipes 220, 230 up to the welded portions 120, 126, divided by the turbine rotor diameter D of the high-temperature turbine rotor constituent part 301 becomes 0.3 or more, it is possible to efficiently reduce the thermal stress generated on the joint surfaces.

Figure 4:
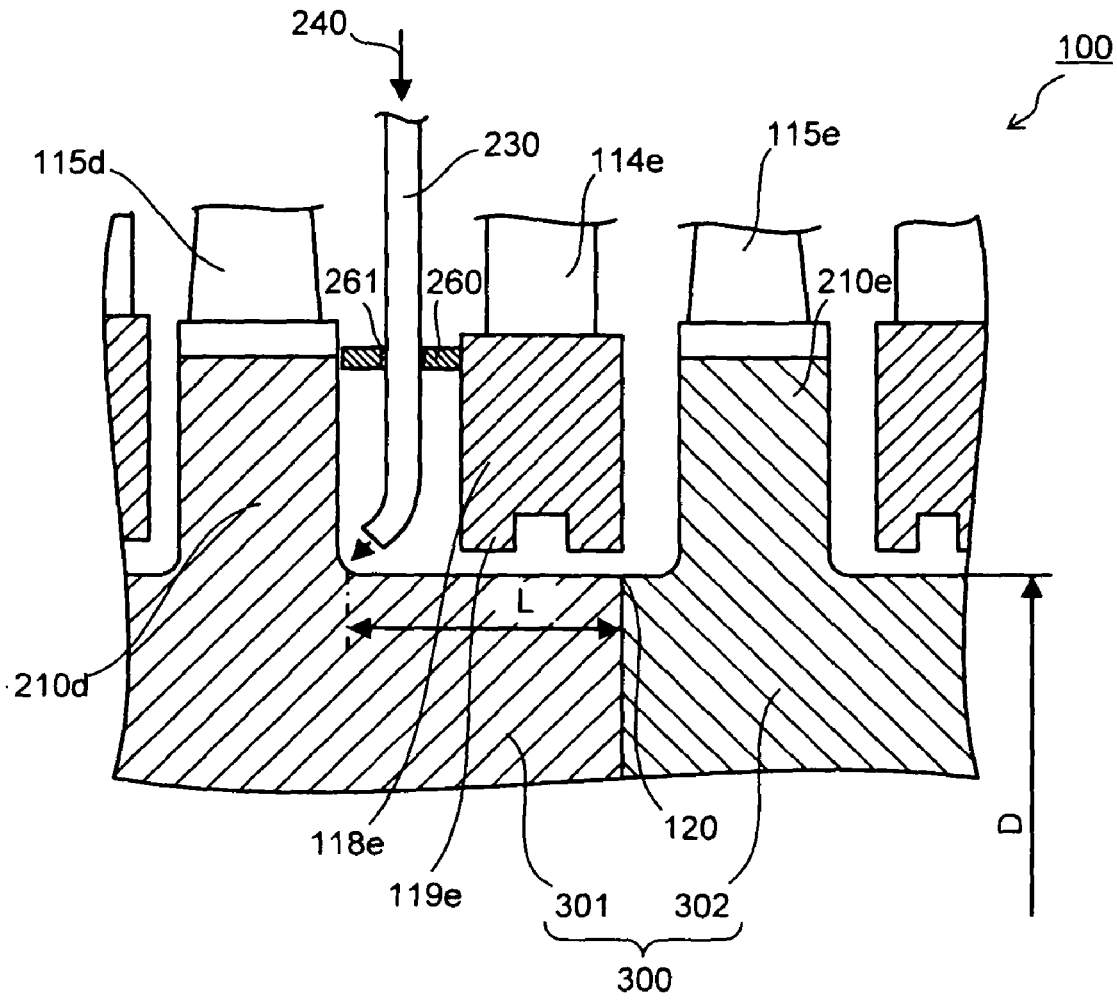
FIG. 4 is an enlarged view of a cross section of the portion including the position, of the high-temperature turbine rotor constituent part, ejected the cooling steam by the cooling steam supply pipe and the welded portion in a case where an extension member is provided on a nozzle diaphragm inner ring.

Here, the steam turbine 100 of the first embodiment is not limited to the above-described embodiment. Another structure of the steam turbine 100 of the first embodiment will now be described. FIG. 4 is an enlarged view of a cross section of the portion including the position, of the high-temperature turbine rotor constituent part 301, ejected the cooling steam 240 by the cooling steam supply pipe 230 and the welded portion 120 in a case where an extension member 260 is provided on the nozzle diaphragm inner ring 118*e*.

As shown in FIG. 4, the extension member 260 having a through hole 261 for having the cooling steam pipe 230 pass therethrough may be provided on the nozzle diaphragm inner ring 118*e* provided on an immediate downstream side of the wheel part 210*d*, so as to extend along the high-temperature turbine rotor constituent part 301 up to the position near the wheel part 210*d*, in an area in which the cooling steam pipe 230 is inserted, that is, an area between the wheel part 210*d* and the nozzle diaphragm inner ring 118*e*.

Concretely, the extension member 260 is made of, for example, a ring-shaped member which has the through hole 261 for having the cooling steam supply pipe 230 pass therethrough, and has a width small enough not to be in contact with the wheel part 210*d*. This ring-shaped member is disposed at a predetermined position of the nozzle diaphragm inner ring 118*e*, with the high-temperature turbine rotor constituent part 301 as a central axis. In a case where the cooling steam supply pipe 230 is provided in plurality around the high-temperature turbine rotor constituent part 301, the through holes 261 are formed at positions corresponding to the respective cooling steam supply pipes 230. The extension member 260 is preferably provided on the nozzle diaphragm inner ring 118*e*, with its wheel part 210*d* side end portion being positioned close to the moving blade 115*d* side of the wheel part 210*d*.

Here, inserting the cooling steam supply pipe 230 between the wheel part 210*d* and the nozzle diaphragm inner ring 118*e* provided on an immediate downstream side of the wheel part 210*d* widens a gap between the wheel part 210*d* and the nozzle diaphragm inner ring 118*e*. The increase of this gap involves a possibility that main steam may be led to this gap. Consequently, part of the main steam flows between the nozzle labyrinth 119*e* and the high-temperature turbine rotor constituent part 301, which is not preferable from a viewpoint of improving efficiency of cooling the high-temperature turbine rotor constituent part 301 by the cooling steam 240. However, providing the extension member 260 as in the present invention can prevent the flow of the main stream into this gap and also can prevent the leakage of the cooling steam 240 to the main stream side. This also enables efficient cooling of the high-temperature turbine rotor constituent part 301 by the cooling steam 240. As described above, since the extension member 260 is provided, with its wheel part 210*d* side end portion being positioned close to the moving blade 115*d* implanted in the wheel part 210*d*, an area exposed to the high-temperature main steam can be reduced in the wheel part 210*d* and the nozzle diaphragm inner ring 118*e*.

Second Embodiment

Next, a steam turbine 100 including a turbine rotor 400 of a second embodiment will be described with reference to FIG. 5.

The structure of the turbine rotor 400 of the second embodiment is the same as the structure of the turbine rotor 300 of the first embodiment except in that the structure of joint end portions of a high-temperature turbine rotor constituent part 401 and low-temperature turbine rotor constituent parts 402 is different from the structure in the turbine rotor 300 of the first embodiment. Therefore, the description here will focus on the structure of the joint end portions of the high-temperature turbine rotor constituent part 401 and the low-temperature turbine rotor constituent part 402.

Figure 5:
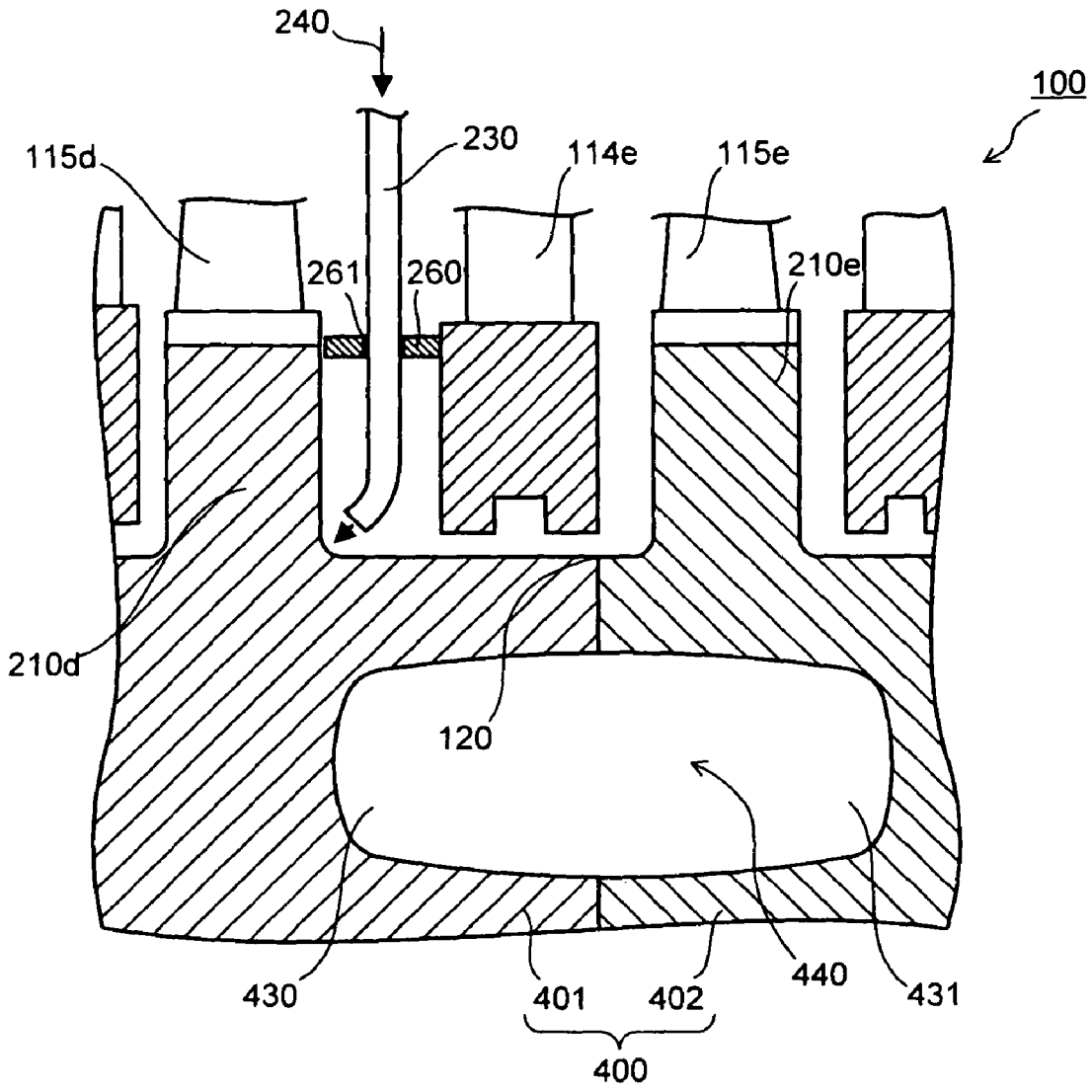
FIG. 5 is a view showing a cross section of a welded portion between a high-temperature turbine rotor constituent part and a low-temperature turbine rotor constituent part in a turbine rotor of a second embodiment according to the present invention.

FIG. 5 is a view showing a cross section of a welded portion 120 between the high-temperature turbine rotor constituent part 401 and the low-temperature turbine rotor constituent part 402 in the turbine rotor 400 of the second embodiment. The same reference numerals and symbols are used to designate the same constituent portions as those of the turbine rotor 300 of the first embodiment, and they will not be redundantly described or will be described only briefly.

As shown in FIG. 5, the joint end surfaces of the high-temperature turbine rotor constituent part 401 and the low-temperature turbine rotor constituent part 402 have recessed portions 430, 431 in a circular shape with the turbine rotor axis being centers thereof; and annular surfaces formed in peripheral edge portions and welded to each other. A space portion 440 is formed inside the welded portion 120.

A depth of the recessed portions 430, 431 formed in the high-temperature turbine rotor constituent part 401 and the low-temperature turbine rotor constituent part 402 is preferably equal to a length up to a position corresponding to a position, of the high-temperature turbine rotor constituent part 401, ejected cooling steam 240 by a cooling steam supply pipe 230. Since the depth of the recessed portions 430, 431 thus equals the length up to the position corresponding to the position, of the high-temperature turbine rotor constituent part 401, ejected the cooling steam 240, it is possible to reduce a volume of a portion, of the high-temperature turbine rotor constituent part 401, cooled by the cooling steam 240. This enables efficient cooling of the high-temperature turbine rotor constituent part 401 and the welded portion 120, which makes it possible to reduce thermal stress generated on the joint surfaces of the welded portion 120 due to a difference in coefficient of linear expansion between materials forming the high-temperature turbine rotor constituent part 401 and the low-temperature turbine rotor constituent part 402.

A joint end portion of the high-temperature turbine rotor constituent part 401 on a side ejected the cooling steam 240 by the cooling steam supply pipe 220 and a joint end portion of the low-temperature turbine rotor constituent part 402 welded to this joint end portion can have the same structure as the above-described structure of the joint end portion of the high-temperature turbine rotor constituent part 401 on the side ejected the cooling steam 240 by the cooling steam supply pipe 230 and the joint end portion of the low-temperature turbine rotor constituent part 402 welded to this joint end portion. This enables efficient cooling of the high-temperature turbine rotor constituent part 401 and the welded portion 126, which makes it possible to reduce thermal stress generated on the joint surfaces of the welded portion 126 due to a difference in coefficient of linear expansion between the materials forming the high-temperature turbine rotor constituent part 401 and the low-temperature turbine rotor constituent part 402, enabling the prevention of breakage or the like.

Figure 6:
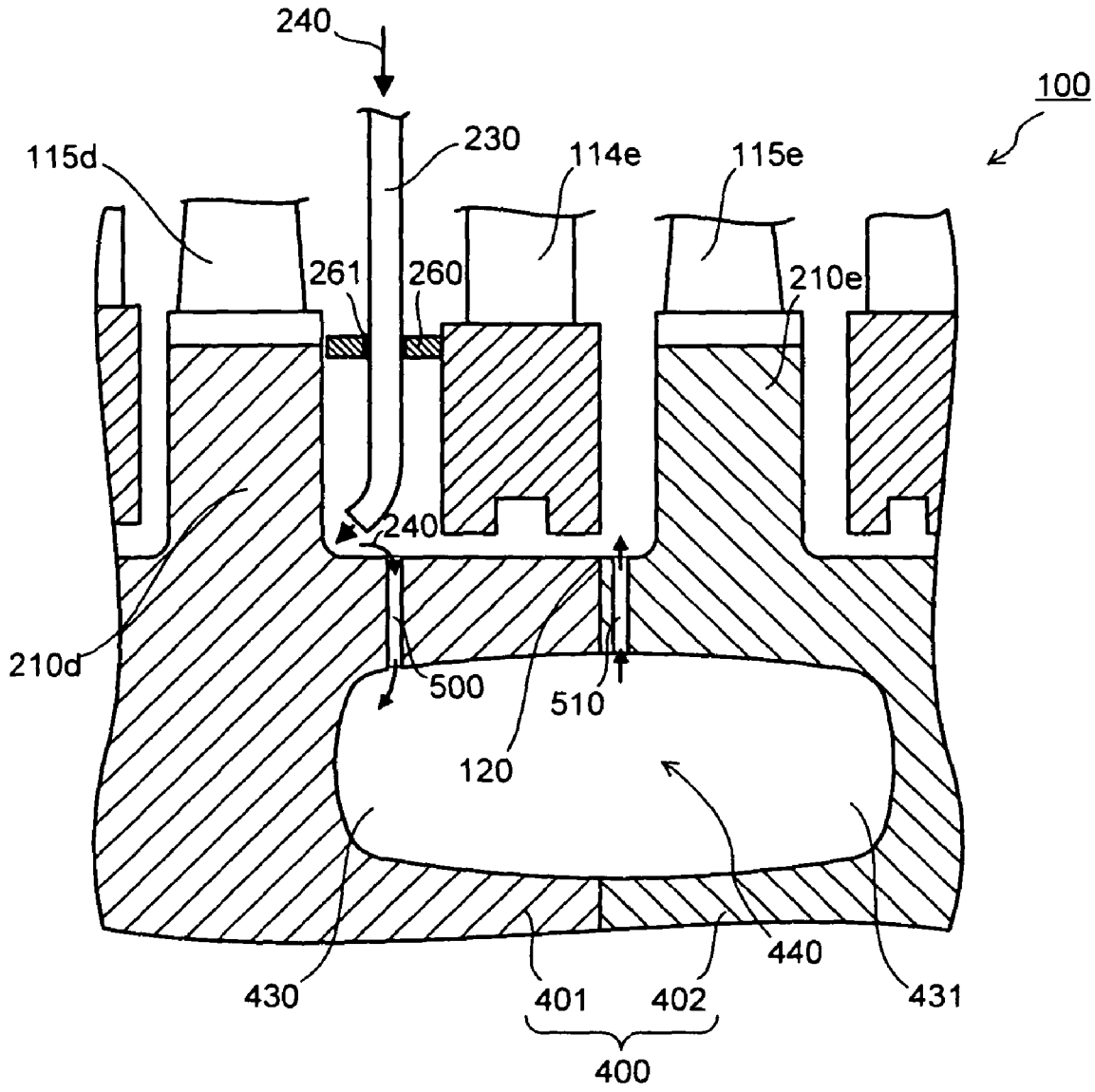
FIG. 6 is a view showing a cross section of the welded portion between the high-temperature turbine rotor constituent part and the low-temperature turbine rotor constituent part in a case where the turbine rotor includes a cooling steam inlet port for introducing part of cooling steam to a space portion.
Figure 7:
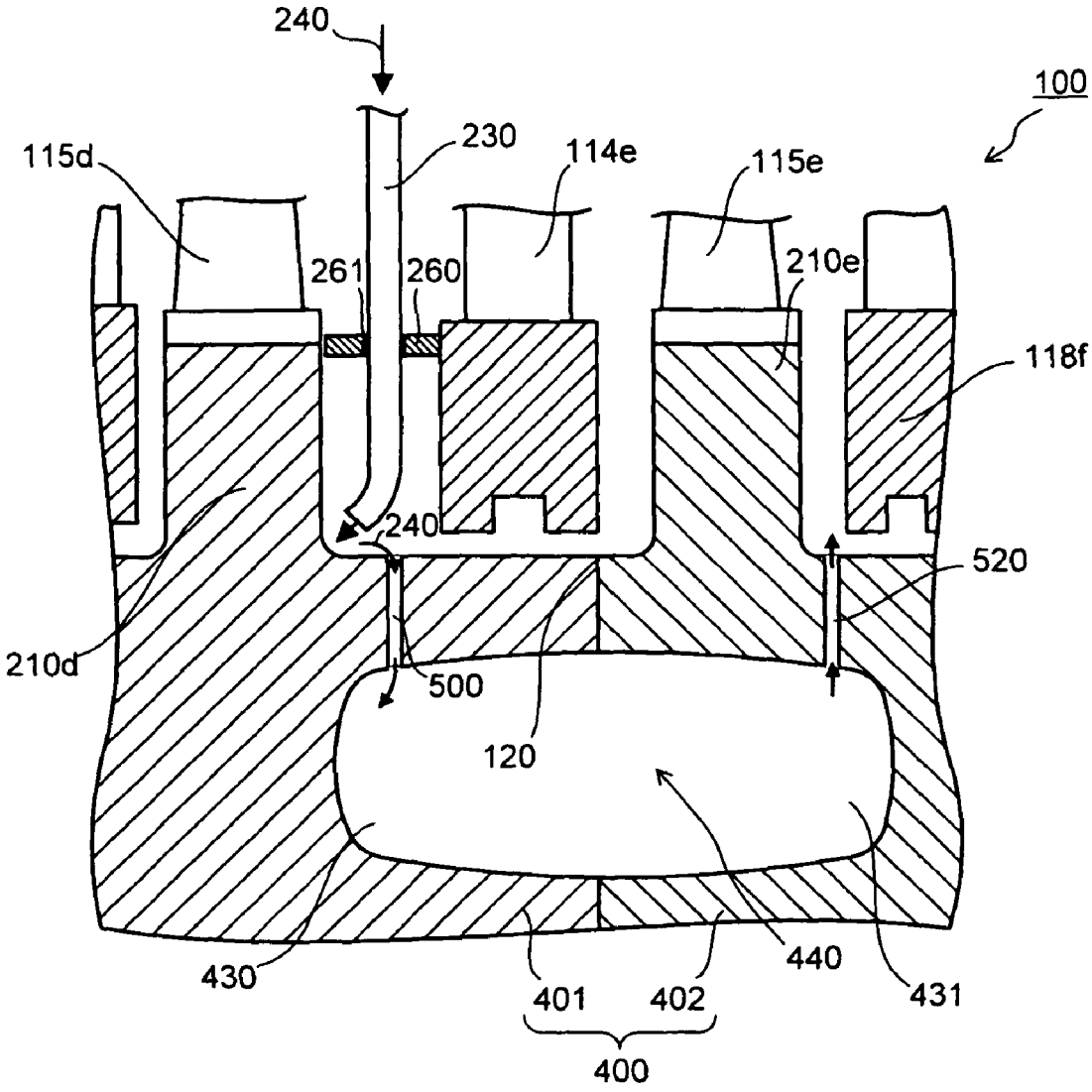
FIG. 7 is a view showing a cross section of the welded portion between the high-temperature turbine rotor constituent part and the low-temperature turbine rotor constituent part in a case where the turbine rotor includes a cooling steam inlet port for introducing part of the cooling steam to the space portion.

Here, the structure of the turbine rotor 400 of the second embodiment is not limited to the above-described structure. Other structures of the turbine rotor 400 of the second embodiment will now be described. FIG. 6 and FIG. 7 are views showing a cross section of the welded portion 120 between the high-temperature turbine rotor constituent part 401 and the low-temperature turbine rotor constituent part 402 in a case where the turbine rotor 400 includes a cooling steam inlet port 500 for introducing part of the cooling steam 240 to the space portion 440.

As shown in FIG. 6, the turbine rotor 400 may include: the cooling steam inlet port 500 which is formed in the high-temperature turbine rotor constituent part 401 and through which part of the cooling steam 240 is introduced into the space portion 440; and a cooling steam discharge port 510 which is formed in the low-temperature turbine rotor constituent part 402, specifically, between the welded portion 120 and a wheel part 210*e* implanted with a moving blade 115*e* on a stage where the steam temperature becomes 550° C. or lower and through which the cooling steam 240 introduced into the space portion 440 is discharged.

Alternatively, as shown in FIG. 7, the turbine rotor 400 may include: a cooling steam inlet port 500 which is formed in the high-temperature turbine rotor constituent part 401 and through which part of the cooling steam 240 is introduced into the space portion 440; and a cooling steam discharge port 520 which is formed in the low-temperature turbine rotor constituent part 402, specifically, between the wheel part 210*e* implanted with the moving blade 115*e* on the stage where the steam temperature becomes 550° C. or lower and a nozzle diaphragm inner ring 118*f* on an immediate downstream side of the wheel part 210*e* and through which the cooling steam 240 introduced into the space portion 440 is discharged.

In the above-described turbine rotors 400, the cooling steam 240 flowing into the space portion 440 from the cooling steam inlet port 500 circulates in the space portion 440 to cool the high-temperature turbine rotor constituent part 401, the welded portion 120, and the low-temperature turbine rotor constituent part 402 from the inside. In particular, a cooling effect of the high-temperature turbine rotor constituent part 401 whose temperature becomes high can be obtained. The cooling steam 240 having circulated in the space portion 440 is discharged through the cooling steam discharge port 510 or 520 to the outside of the low-temperature turbine rotor constituent part 402.

By thus introducing part of the cooling steam 240 into the space portion 440 to cool the high-temperature turbine rotor constituent part 401 and the welded portion 120 also from the inside, it is possible to efficiently cool the high-temperature turbine rotor constituent part 401 and the welded portion 120, and consequently, near the welded portion 120, a temperature difference between the high-temperature turbine rotor constituent part 401 and the low-temperature turbine rotor constituent parts 402 can be reduced to a minimum. This can reduce thermal stress generated on the joint surfaces of the welded portion 120 due to a difference in coefficient of linear expansion between the materials forming the high-temperature turbine rotor constituent part 401 and the low-temperature turbine rotor constituent part 402, enabling the prevention of breakage or the like.

Incidentally, as in the above-described structure, a cooling steam inlet port for introducing part of the cooling steam 240 into a space portion and a cooling steam discharge port for discharging the cooling steam 240 having circulated in the space portion 440 may be provided also in the high-temperature turbine rotor constituent part 401 on a side supplied with the cooling steam 240 by the cooling steam supply pipe 220 and the low-temperature turbine rotor constituent part 402. In this case, as in the above-described case, it is possible to efficiently cool the high-temperature turbine rotor constituent part 401 and the welded portion 126, and consequently, near the welded portion 126, a temperature difference between the high-temperature turbine rotor constituent part 401 and the low-temperature turbine rotor constituent parts 402 can be reduced to a minimum. This can reduce thermal stress generated on joint surfaces of the welded portion 126 due to a difference in coefficient of linear expansion between the materials forming the high-temperature turbine rotor constituent part 401 and the low-temperature turbine rotor constituent part 402, enabling the prevention of breakage or the like.

The present invention has been concretely described based on the embodiments, but the present invention is not limited to these embodiments, and various modifications can be made without departing from the spirit of the present invention.

What is claimed is:

1. A turbine rotor penetratingly provided in a steam turbine to which high-temperature steam is introduced, the turbine rotor comprising:

a high-temperature turbine rotor constituent part where the high-temperature steam passes;

low-temperature turbine rotor constituent parts sandwiching and weld-connected to said high-temperature turbine rotor constituent part and made of a material different from a material of said high-temperature turbine rotor constituent part; and a cooling part cooling said high-temperature turbine rotor constituent part by ejecting cooling steam to a position, the position being located on said high-temperature turbine rotor constituent part with a predetermined distance from a welded portion between said high-temperature turbine rotor constituent part and each of said low-temperature turbine rotor constituent parts, the predetermined distance being satisfied that the predetermined distance divided by a turbine rotor diameter of the high-temperature turbine rotor constituent part is equal to or more than 0.3, wherein said cooling part ejects the cooling steam toward a side surface or a root portion of as rotor wheel part in said high-temperature turbine rotor constituent part.

2. The turbine rotor as set forth in claim 1, wherein said cooling part includes a cooling steam pipe for ejecting the cooling steam to said high-temperature turbine rotor constituent part.

3. The turbine rotor as set forth in claim 1, wherein said cooling part ejects the cooling steam toward a side surface or a root portion of a second rotor wheel part, in said high-temperature turbine rotor constituent part, on one-stage upstream side of a first rotor wheel part implanted with a moving blade where the temperature of the steam becomes 550° C. or lower.

4. The turbine rotor as set forth in claim 1, wherein the welded portion is formed at a position substantially corresponding to a downstream end portion of a nozzle diaphragm inner ring positioned on an immediate upstream side of a moving blade on a stage where the temperature of the steam becomes 550° C. or lower, or a position substantially corresponding to a downstream end portion of a nozzle labyrinth provided in the nozzle diaphragm inner ring.

5. The turbine rotor as set forth in claim 1, wherein joint end surfaces of said high-temperature turbine rotor constituent part and said low-temperature turbine rotor constituent part have: circular recessed portions formed in center portions; and annular surfaces formed in peripheral edge portions, and joined to each other by welding, and a space portion is formed inside the turbine rotor.

6. The turbine rotor as set forth in claim 5, wherein a cooling steam inlet port for introducing part of the cooling steam into the space portion is formed in said high-temperature turbine rotor constituent part and a cooling steam discharge port for discharging the cooling steam introduced into the space portion is formed in said low-temperature turbine rotor constituent part.

7. A steam turbine to which high-temperature steam is introduced and which comprises:

a casing; and a turbine rotor penetratingly provided in the casing, wherein said turbine rotor comprises:

high-temperature turbine rotor constituent part where the high-temperature steam passes;

low-temperature turbine rotor constituent parts sandwiching and weld-connected to said high-temperature turbine rotor constituent part and made of a material different from a material of said high-temperature turbine rotor constituent part; and a cooling part cooling said high-temperature turbine rotor constituent part by ejecting cooling steam to a position, the position being located on said high-temperature turbine rotor constituent part with a predetermined distance from a welded portion between said high-temperature turbine rotor constituent part and each of said low-temperature turbine rotor constituent parts, and the predetermined distance being satisfied that the predetermined distance divided by a turbine rotor diameter of the high-temperature turbine rotor constituent part is equal to or more than 0.3, wherein said cooling part ejects the cooling steam toward a side surface or a root portion of a rotor wheel part in said high-temperature turbine rotor constituent part.

8. The steam turbine as set forth in claim 7, wherein said cooling part includes a cooling steam pipe for ejecting the cooling steam to said high-temperature turbine rotor constituent part.

9. The steam turbine as set forth in claim 7, wherein said cooling part ejects the cooling steam toward a side surface or a root portion of a second rotor wheel part, in said high-temperature turbine rotor constituent part, on one-stage upstream side of a first rotor wheel part implanted with a moving blade where the temperature of the steam becomes 550° C. or lower.

10. The steam turbine as set forth in claim 7, wherein the welded portion is formed at a position substantially corresponding to a downstream end portion of a nozzle diaphragm inner ring positioned on an immediate upstream side of a moving blade on a stage where the temperature of the steam becomes 550° C. or lower, or a position substantially corresponding to a downstream end portion of a nozzle labyrinth provided in the nozzle diaphragm inner ring.

11. The steam turbine as set forth in claim 7, wherein joint end surfaces of said high-temperature turbine rotor constituent part and said low-temperature turbine rotor constituent part have; circular recessed portions formed in center portions; and annular surfaces formed in peripheral edge portions and joined to each other by welding, and a space portion is formed inside the turbine rotor.

12. The steam turbine as set forth in claim 1 wherein a cooling steam inlet port for introducing part of the cooling steam into the space portion is formed in said high-temperature turbine rotor constituent part and a cooling steam discharge port for discharging the cooling steam introduced into the space portion is formed in said low-temperature turbine rotor constituent part.

13. The steam turbine as set forth in claim 9, further comprising an extension member provided on a nozzle diaphragm inner ring on an immediate downstream side of said second rotor wheel part, extending along said high-temperature turbine rotor constituent part up to a position near said second rotor wheel part, in an area which is between said second rotor wheel part and said nozzle diaphragm inner ring and in which said cooling steam pipe is inserted, and provided with a through hole for having the cooling steam pipe pass therethrough.

* * * * *